US006637618B2

(12) United States Patent
Friederich

(10) Patent No.: US 6,637,618 B2
(45) Date of Patent: Oct. 28, 2003

(54) COVERING DEVICE FOR A CONTAINER

(76) Inventor: Rudiger Friederich, Dunantstrasse 5, 75031 Eppingen (DE)

( * ) Notice: Subject to any disclaimer, the term of this patent is extended or adjusted under 35 U.S.C. 154(b) by 0 days.

(21) Appl. No.: 10/161,578

(22) Filed: Jun. 3, 2002

(65) Prior Publication Data

US 2002/0195456 A1 Dec. 26, 2002

Related U.S. Application Data

(63) Continuation of application No. PCT/DE00/04322, filed on Dec. 4, 2000.

(30) Foreign Application Priority Data

Dec. 3, 1999 (DE) ..... 199 58 277

(51) Int. Cl.[7] ..... B65D 43/04
(52) U.S. Cl. ..... 220/845; 220/847
(58) Field of Search ..... 220/263, 229, 220/264, 287, 810, 703, 845, 740, 847, 757, 759, 754, 324; 215/235, 239

(56) References Cited

U.S. PATENT DOCUMENTS

| | | | | | |
|---|---|---|---|---|---|
| 550,842 | A | * | 12/1895 | Peters | 220/848 |
| 1,417,282 | A | * | 5/1922 | Senio | 215/235 |
| 1,733,807 | A | * | 10/1929 | Landes | 215/244 |
| 2,552,397 | A | * | 5/1951 | Bretney | 215/236 |
| 3,107,029 | A | * | 10/1963 | Rylander | 220/740 |
| 4,494,672 | A | * | 1/1985 | Pearson | 220/263 |
| 4,708,273 | A | * | 11/1987 | Grant | 224/148.6 |
| 4,735,338 | A | * | 4/1988 | Stancil | 220/324 |
| 4,872,577 | A | * | 10/1989 | Smith | 220/739 |
| 5,944,238 | A | * | 8/1999 | Stark | 224/148.4 |
| 6,478,179 | B1 | * | 11/2002 | Alexander | 220/325 |

FOREIGN PATENT DOCUMENTS

| | | |
|---|---|---|
| DE | 83 20 081 U | 5/1984 |
| DE | 43 25 925 A1 | 2/1995 |
| DE | 296 00 246 U1 | 4/1996 |
| DE | 299 21 187 U1 | 3/2000 |

* cited by examiner

*Primary Examiner*—Stephen K. Cronin
*Assistant Examiner*—James Smalley
(74) *Attorney, Agent, or Firm*—Alston & Bird LLP

(57) ABSTRACT

A covering device for a container (1) having an annular rim (2), such as a drink can, a yogurt cup, a glass, or the like. The device includes a lid (4) adapted for pivoting about an axis (3) on a holder (5) that is adapted for securing the device on the container by means of a clamping element (6) positioned on the outside of the annular rim and a counter support (7) cooperating with the clamping device (6) and positioned on the inside of the annular rim. The clamping element includes two annularly spaced apart jaws (8), which can be moved by an actuation element (9) from a clamping position to an open position where the rim is released.

10 Claims, 5 Drawing Sheets

COVERING DEVICE FOR A CONTAINER

CROSS REFERENCE TO RELATED APPLICATIONS

This application is a continuation of pending PCT International Application PCT/DE00/04322, filed Dec. 4, 2000, designating *inter alia* the United States.

BACKGROUND OF THE INVENTION

The invention relates to a covering device for a container with a rim, in particular a drink can, a yogurt cup, a glass, or the like, with a lid adapted for pivoting about an axis, and a holder, which is used for arranging the device on the container.

DE 296 00 246 U1 discloses a covering device of the initially described type. Specifically, the known covering device is used to cover a drink glass. The drink glass includes a rim, which forms the upper end of the glass body. The lid forming a part of the covering device is adapted for pivoting about an axis. To arrange the covering device on the container, a holder is provided. The holder comprises two parallel extending legs, which receive between them a large portion of the wall of the drink glass.

However, there also are containers, which have at least in their closed state no accessible, large-surface wall, such as, for example, a drink can. Since such drink cans have in most cases a short upper edge that extends only to a small extent in the vertical direction, they do not provide a reliable securement of the known covering device.

It is therefore an object of the present invention to describe a covering device for a container with a rim, with the covering device permitting a safe arrangement with constructionally simple means on any type of container with a rim.

SUMMARY OF THE INVENTION

The above and other objects and advantages of the invention are achieved by the provision of a closing device which comprises a holder configured for releasable securement onto the rim of the container, and a lid pivotally mounted to the holder for pivotal movement about an axis. The holder comprises a clamping element and a counter support cooperating with the clamping element, and so that the rim can be positioned therebetween and pressed by the clamping element against the counter support.

In accordance with the invention, it has been recognized that a reliable securement of a covering device is possible exclusively on the rim of a container, without having to use large areas of the container wall. Thus, with the present invention only the rim of the container is used for securing the covering device on the container.

Consequently, the covering device of the present invention denotes a covering device, which enables with simple constructional means a reliable securement on anytype of container with a rim.

As regards a particularly reliable securement of the covering device on the container, the clamping element includes two clamping jaws that are adapted for movement within a plane defined by the rim of the container. Preferably, the plane corresponds to the plane of the rim. Contrary to the covering device known from the art, the covering device is secured in place on the container not by locking in the vertical direction, namely downwardly along the container wall, but rather in the horizontal direction, namely within the plane defined by the rim. In all cases, the counter support has the function of an abutment for the clamping effect that is exerted by the clamping element or clamping jaws.

In a particularly practical manner the clamping element or clamping jaws are adapted for movement by means of an actuation element. Concretely, the actuation element could include two levers, each acting upon a clamping jaw. By means of the levers, the clamping jaws are naturally biased in order to press upon the rim as a result of their inherent elasticity with the cooperation of the counter support. This clamping principle is however also realized without an actuation element or lever.

As regards a particularly effective lever action, it is possible to arrange the levers in the plane of the clamping jaws. This avoids bending moments in undesired directions with components perpendicular to the plane.

Furthermore, with respect to a particularly simple actuation of the levers, the levers could be spaced such that they can be gripped with the fingers of one hand, thereby realizing a one-hand operation of the covering device.

As regards a particularly reliable securement of the clamping jaws relative to each other, the clamping jaws could be interconnected via a coupling member, thereby accomplishing an optimal cooperation of the clamping jaws. Concretely, it would be possible to arrange the clamping jaws and the coupling member along a curved line. Such a line could be a portion of a circle.

To ensure a particularly large engagement surface between the rim and clamping element, the clamping element or the clamping jaws, and/or the coupling member could be adapted to the curvature of the rim, thereby ensuring in essence a surface contact.

As regards a particularly reliable securement of the covering device on the container, the clamping element or clamping jaws could be designed and constructed so as to engage below the rim. This would effectively preclude the holder or clamping element from unintentionally slipping away from the container.

During its action as an abutment, the counter support could be adapted for engaging the inner side of the rim. In other words, in this instance the clamping element presses from the outside against the rim of the container. However, it is also possible that the clamping element presses on the inner side of the rim. In this instance, the counter support is adapted for engaging the outside of the rim.

Concretely, the counter support could be formed by a plate-shaped element, which could preferably be adapted to the curvature of the rim, thereby realizing a constructionally very simple configuration.

To prevent the holder from slipping away from the rim and, with that, the entire covering device from the container, the clamping element, or clamping jaws, and/or counter support could be provided with a special section, a roughened surface, or a coating. This would permit realizing a yet more reliable engagement between the holder and the container. In this way, the clamping element, or clamping jaws, and/or the counter support could be coated as an alternative or in addition with a soft plastic or elastomer, with rubber, or a rubberlike material. As a result, it is possible to further increase the reliability of the arrangement of the covering device on the container.

In a particularly simple manner, the lid and the holder could be coupled by means of a pivot joint. In the alternative, the lid and the holder could be coupled by means of a snap action joint, which could comprise a film hinge. In this case, it would be possible to provide between the lid and holder a connection element, which is stationary, while the lid is being pivoted relative to the container. The connection element and the lid could be made integral, while yet permitting the lid to pivot toward the connection element.

As regards a comfortable pivotal movement of the lid, one could provide a stop that limits the pivotal movement of the lid. In other words, it would be possible to pivot the lid away from the rim of the container only as far as a certain position.

Depending on need, the lid could cover the container in part or also completely. In particular a full covering offers in most cases a maximal protection against insect penetration into the container.

In a further advantageous manner, the lid could include a sealing device for closing the container in a preferably leakproof and/or airtight manner. With that, one would realize not only a covering of the container, which prevents to the greatest extent, for example, insects from penetrating, but also a closure of the container for the fresh keeping of, for example, carbonated drinks. In particular in the case of a container constructed as a drink can, the sealing device could be adapted to the prestamped opening of the drink can. The sealing device would include a preferably annular rubber seal. Furthermore, the sealing device could be arranged in the covered state of the container so as to be essentially invisible below the lid.

As regards a particularly practical configuration of the covering device, the sealing device could comprise preferably circular sealing means along the edge of the underside of the lid. The sealing means could be arranged on the lid such that in the closed state of the lid, they abut in surrounding relationship the rim of the container outside of the container, or the rim of the container inside thereof. In all cases, the container would be sealed. In a particularly advantageous manner, adhesive or clamping forces could be effective between the container and the sealing means, so that the lid is held in its closed state by means of the sealing means. The sealing means could be made as a gummed surface, a coating, an O-ring, or the like, thereby enabling a particularly simple production of a covering device with sealing means.

As an alternative or in addition, the sealing device could comprise sealing means that are adapted to the drink hole of the container. These sealing means could be dimensioned such that they fit into the drink hole preferably in a wedge-shaped sealing relationship. This will be especially advantageous, when the container is used in the car, on the road, or otherwise en route.

As regards a particularly simple production, it would be possible to make the sealing means from plastic, rubberlike material, or the like, preferably integral with the lid. The sealing means could be made, for example, in two pieces such that one part of the sealing means is associated to the drink hole, whereas the other part of the sealing means is associated to the lid, and sealingly engages the first sealing means in the closed state of the lid.

With respect to a particularly flexible configuration, the lid could comprise a predetermined breaking point for piercing the lid with a drink straw. This would be especially of advantage, when the covering device is used en route and/or by children.

As regards a very satisfactory transportability of containers, which are closed with the covering device, the lid could be constructed such that in the closed position of the lid, at least one portion of the lid engages the container, so that the lid is kept in its closed position. This could be realized, for example, in that a snap mechanism is arranged on the edge of the lid. In particular in combination with a sealing device, the container is now especially well protected against leakage of fluid.

In an economically especially favorable manner, the lid could be constructed as a carrier of advertisements or data, with the upper side of the lid presenting itself for imprinting advertisements.

As regards a particularly economical production of the covering device, the lid and holder could be made of plastic, preferably by the injection molding method. In this process, the lid and holder, and possibly a connection element could be made integral.

The covering device of the invention is adapted for a reliable mounting in particular in the case of a drink can with a folded rim.

There are various possibilities of improving and further developing the teaching of the present invention in an advantageous manner. To this end, one may refer to the following detailed description of an embodiment of the covering device in accordance with the invention with reference to the drawing. In conjunction with the detailed description of the preferred embodiment of the covering device according to the invention with reference to the drawing, also generally preferred improvements and further developments of the teaching are explained.

DETAILED DESCRIPTION OF THE PREFERRED EMBODIMENTS

Figure 1:
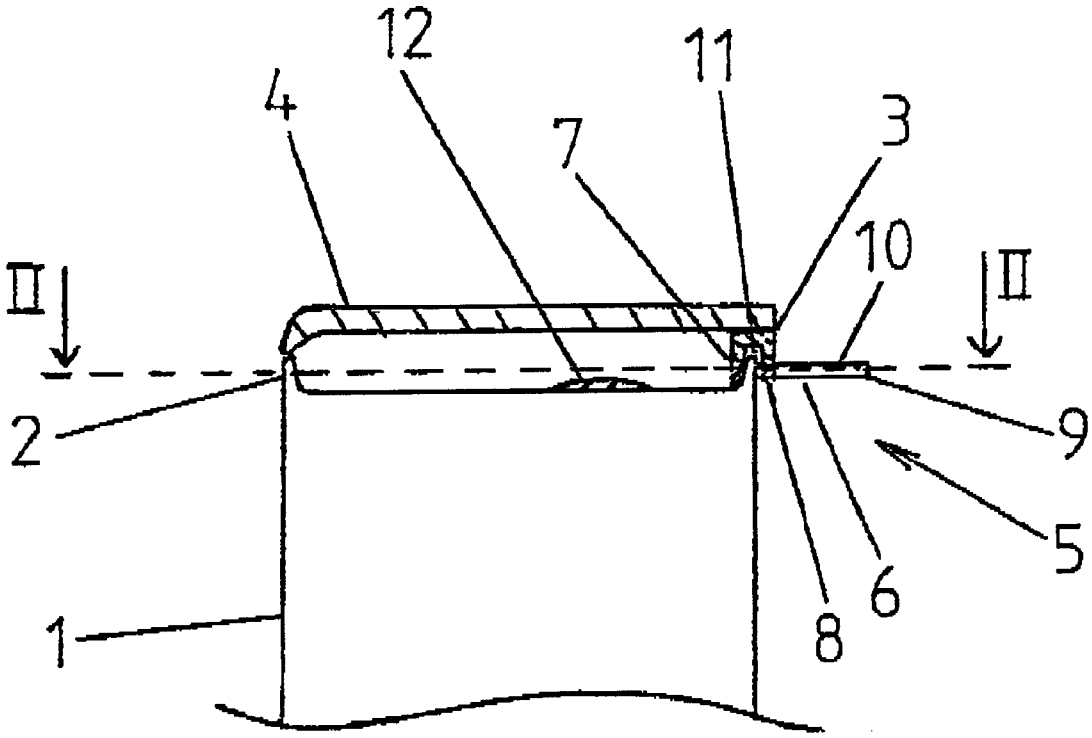
FIG. 1 is a schematic sectional view of an embodiment of a covering device according to the invention in a state arranged on a drink can.

FIG. 1 is a schematic and sectional view of an embodiment of a covering device-according to the invention for a container 1 with a rim 2, with a drink can forming the container 1. The covering device comprises a lid 4, which is adapted for pivoting about an axis 3, and a holder 5 for securing the device on container 1. With respect to a reliable securement of the covering device on any type of container 1 with a rim 2, the covering device is designed and constructed such that the holder 5 comprises a clamping element 6 and a counter support 7 cooperating with clamping element 6, and that the clamping element 6 is adapted for pressing the rim 2 against the counter support 7.

The clamping element 6 comprises two clamping jaws 8, which are spaced apart and movable within the plane of rim 2. The clamping jaws 8 thus engage in surrounding relationship a portion of the rim 2. For biasing or actuating the clamping jaws 8, an actuation device 9 is provided, which comprises two radially directed levers 10, each acting upon one clamping jaw 8. The levers 10 are arranged in the plane of the clamping jaws 8 and spaced from each other such that they can be gripped with the fingers of one hand.

To mount the covering device to the container 1, the clamping jaws 8 are first biased to an open position by means of levers 10. Subsequently, the covering device is placed on container 1 with holder 5. In this instance, the rim 2 enters a receiving area 11, which is defined on the one hand by counter support 7, and on the other hand by clamping element 6. Finally, the clamping jaws 8 are released, which results in that the clamping jaws 8 naturally assume a clamping position where they clamp against the rim 2, with the counter support 7 serving as an abutment.

The lid 4 covers the entire container 1 in the form of a drink can. In so doing, it covers in particular an opening device 12 of the drink can.

Figure 2:
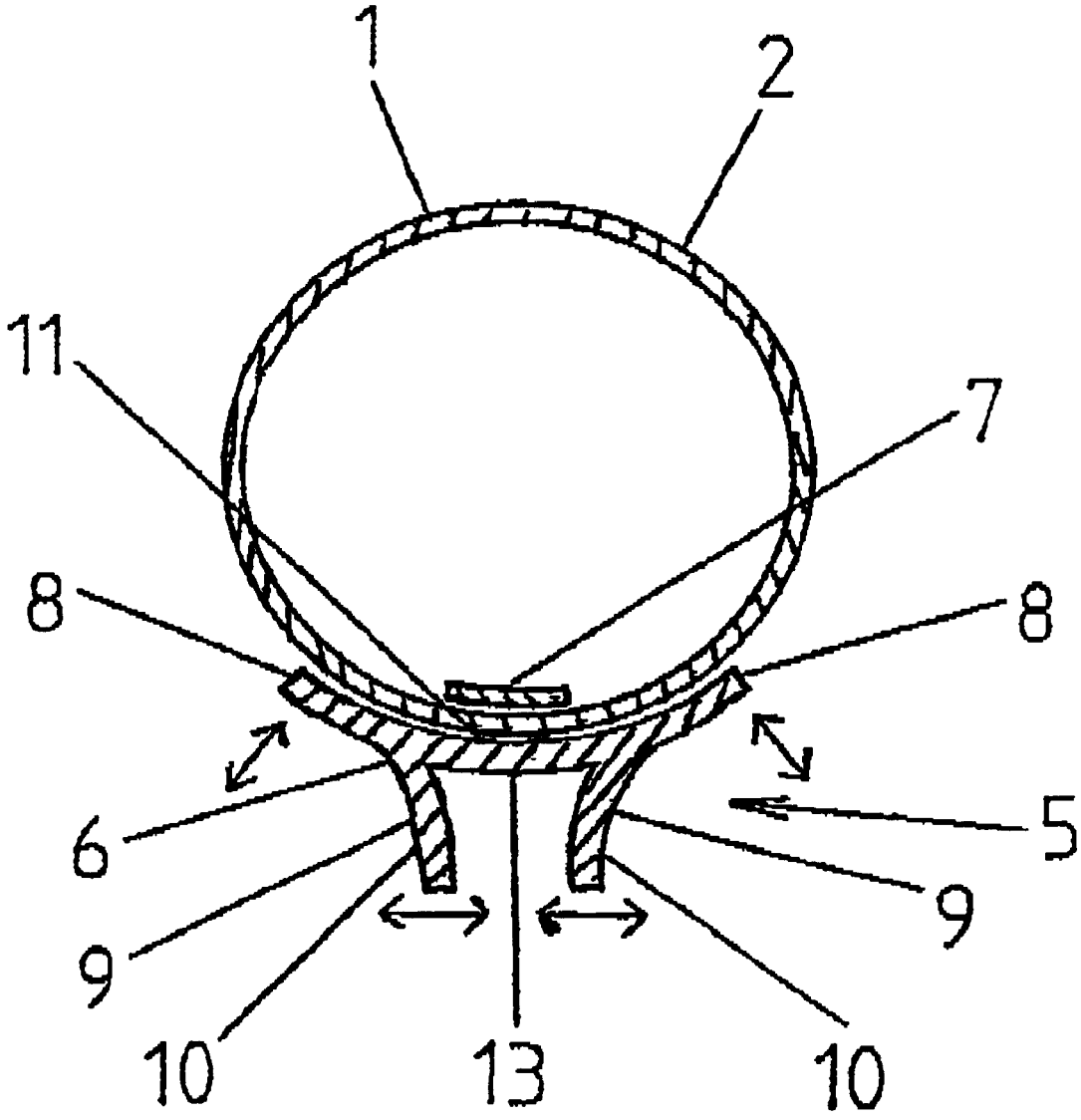
FIG. 2 is a schematic sectional top view of the embodiment of FIG. 1 along line II—II of FIG. 1.

FIG. 2 is a schematic sectional top view of the embodiment of FIG. 1 along line II—II thereof. This Figure shows best the configuration of clamping element 6 of the holder 5. In the mounted state of the covering device, the clamping jaws 8 clamp against the rim 2 of container 1, with the counter support 7 serving as an abutment. The counter support 7 is arranged on the inner side of rim 2.

The clamping jaws 8 are formed along a curved line substantially corresponding to the curvature of rim 2, with a coupling member 13 being provided between the clamping jaws 8. To move the clamping jaws 8 to the open position, two actuation elements 9 are provided in the form of levers 10. For example, when the levers 10 are compressed with two fingers of one hand, they will open the clamping jaws 8. After releasing the levers 10, the clamping jaws 8 will move as a result of their inherent elasticity toward the rim 2. The possible movements of the actuation elements 9 and clamping jaws 8 are indicated by double arrows.

Figure 3:
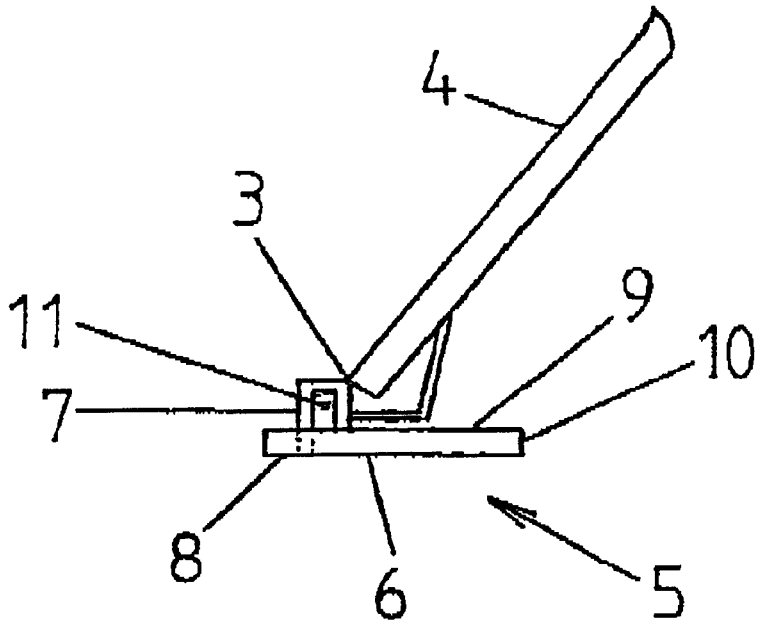
FIG. 3 is a schematic and enlarged side view of the embodiment of FIG. 1 in its opened state.
Figure 4:
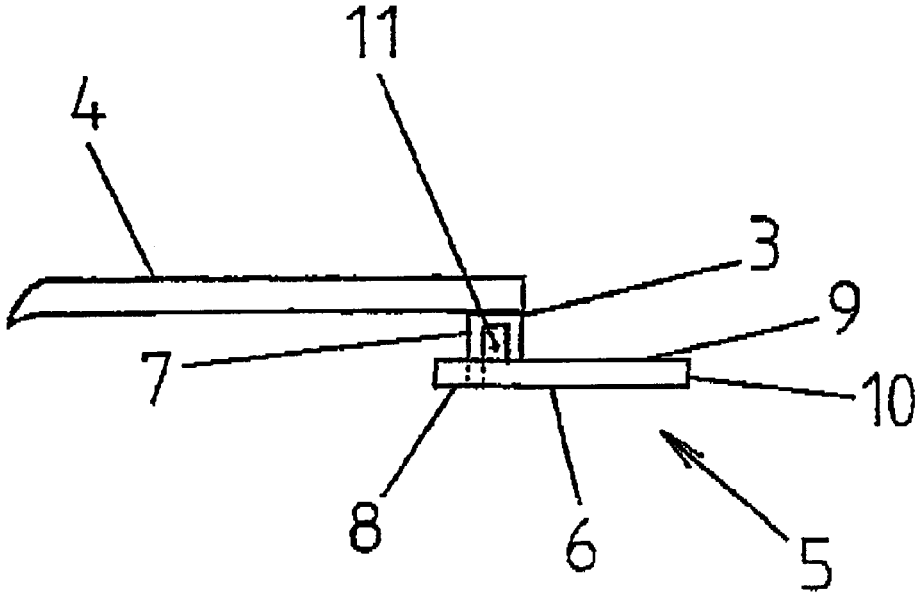
FIG. 4 is a schematic and enlarged side view of the embodiment of FIG. 1 in its closed state.

FIGS. 3 and 4 are each a schematic side view of the embodiment of FIG. 1, one in the opened state, and one in the closed state of the lid 4. The lid 4 and holder 5 are interconnected by a snap joint, which is constructed as a film hinge. A reliable closing of a container is made possible because of the inherent elasticity of the material of the film hinge, or holder 5, and lid 4. In this instance, there exists a snap effect. As regards the further components shown in FIGS. 3 and 4 in addition to the lid 4 and holder 5, the description of FIG. 1 is herewith incorporated by reference for purposes of avoiding repetitions.

Figure 5:
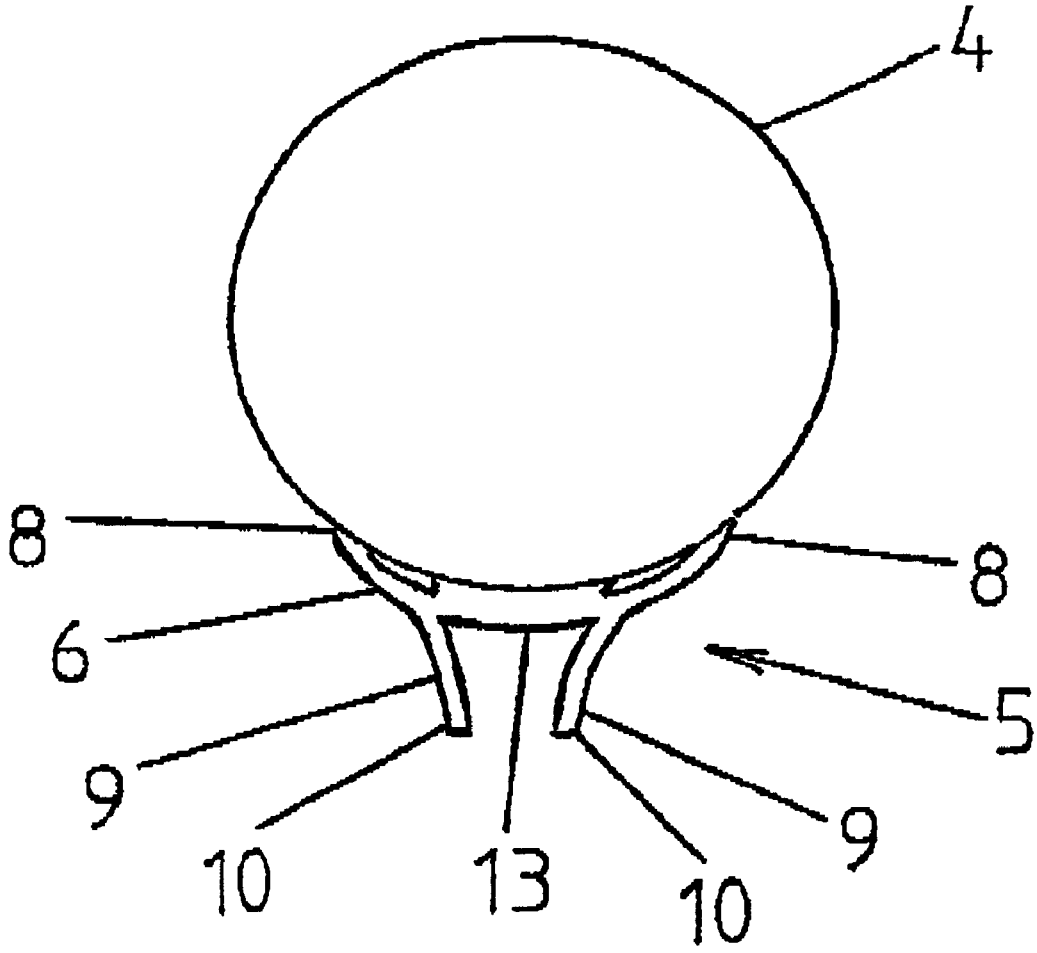
FIG. 5 is a schematic top view of the embodiment of FIG. 1.

FIG. 5 is a schematic top view of the embodiment of FIG. 1. The lid 4 and holder 5 are interconnected to form an integral part. The clamping jaws 8 of clamping element 6 extend in their released and unassembled state below the lid 4, as is shown in phantom lines. The clamping jaws 8 are interconnected via a coupling member 13. The actuation elements 9 in the form of levers 10 are joined to the clamping element 6 to form likewise an integral part. As a result, the levers 10 extend continuously as an extension of the clamping jaws 8.

Figure 6:
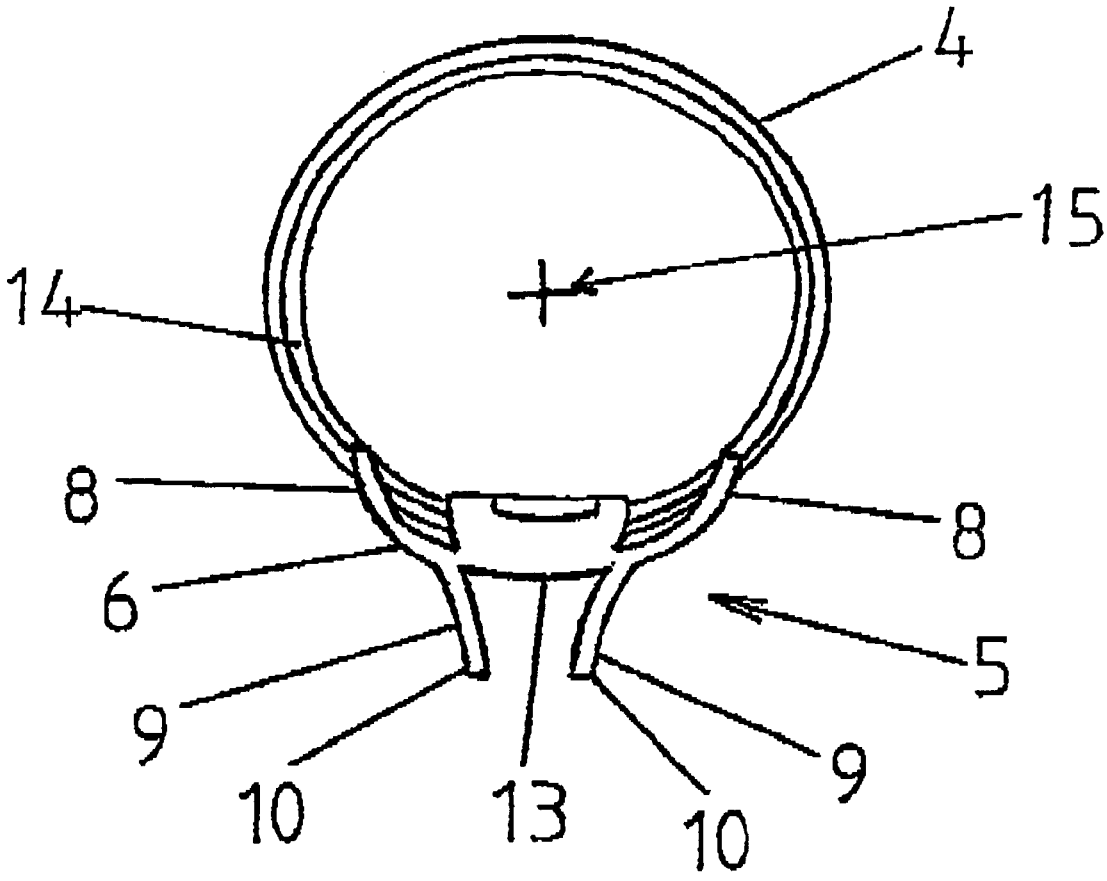
FIG. 6 is a schematic view from the bottom of a further embodiment of a covering device according to the invention with a sealing device and a predetermined breaking point for a drink straw.

FIG. 6 is a schematic view from the bottom of a further embodiment of a covering device according to the invention with a sealing device 14, which comprises a circular sealing means that is arranged on the underside of lid 4. The sealing means is a gummed surface, which is arranged on the lid 4 in such a manner that it lies within container 1 against the rim thereof. A predetermined breaking point 15 for piercing the lid 4 with a drink straw not shown, makes it possible to use the straw for emptying the container 1.

As regards further advantageous configurations of the covering device according to the invention, the general part of the specification as well as the attached claims are herewith incorporated by reference for avoiding repetitions.

Finally, it should be explicitly remarked that the foregoing embodiment is used only for describing the claimed teaching in greater detail, without however limiting it to the embodiment.

What is claimed is:

1. A covering device for a container having an annular rim, comprising a holder configured for releasable securement onto the rim of the container, a lid pivotally mounted to the holder for pivotal movement about an axis, and wherein the holder comprises a clamping element and a counter support which are configured to receive the rim therebetween with the clamping element pressing the rim against the counter support, and with the clamping element comprising two clamping jaws which are moveable toward and away from the rim within a plane which is parallel to a plane defined by the rim, wherein the jaws are integrally interconnected and are spaced apart along a curved line which generally corresponds to the curvature of the annular rim, and wherein a coupling member is positioned between said jaws along said curved line, wherein the two clamping jaws are moveable between a clamping position wherein the jaws press the rim against the counter support, and an open position, and wherein the two clamping jaws are naturally biased to assume the clamping position, wherein said holder further comprises an actuation element for selectively moving the clamping jaws from the clamping position to the open position, with said actuation element comprises two radially directed levers, with each lever being connected to one clamping jaw such that movement of the levers toward each other causes the jaws to move toward the open position.

2. The clamping device of claim 1 wherein the two levers are spaced apart so that they may be moved toward each other with the fingers of one hand.

3. The clamping device of claim 1 wherein the counter support is positioned radially inside of said jaws so as to engage the inside of the rim while the jaws engage the outside of the rim.

4. The clamping device of claim 1 wherein the counter support and the jaws each have a surface which engages the rim and which is roughened or coated to facilitate its engagement with the rim.

5. The clamping device of claim 1 wherein the lid is pivotally mounted to the holder by means of a snap joint.

6. The clamping device of claim 1 wherein the lid includes an annular sealing member for closing the container in a leakproof and/or airtight manner.

7. The clamping device of claim 1 wherein the lid includes a breaking point where the lid may be pierced by a drinking straw.

8. The clamping device of claim 1 wherein the lid is pivotable to a closed position wherein it engages the container and wherein the lid is pivotally mounted to the holder so that the lid is held in the closed position.

9. The clamping device of claim 1 wherein the lid and the holder are each composed of a molded plastic material.

10. The clamping device of claim 1 wherein the lid and the holder are made integral.

* * * * *